US006109490A

United States Patent [19]

Caluori

[11] Patent Number: 6,109,490

[45] Date of Patent: Aug. 29, 2000

[54] WRIST MOUNTED WHISTLE

[76] Inventor: Michael J. Caluori, 3948 Trempealeau Trail, Verona, Wis. 53593

[21] Appl. No.: 09/097,553

[22] Filed: Jun. 15, 1998

[51] Int. Cl.[7] ..... A45F 5/00

[52] U.S. Cl. ..... 224/220; 224/219; 224/267; 446/204; 24/3.2; 24/3.13; 2/160

[58] Field of Search ..... 224/191, 219–222, 224/267, 250, 255, 910, 257, 258; 446/204, 205, 206; 24/3.2, 3.4, 3.13; 116/137 R; 2/160

[56] References Cited

U.S. PATENT DOCUMENTS

| | | | |
|---|---|---|---|
| D. 268,175 | 3/1983 | Kong . | |
| 1,258,077 | 3/1918 | Worcester | 224/221 X |
| 2,572,889 | 10/1951 | Strykower . | |
| 2,728,501 | 12/1955 | Hill . | |
| 2,911,694 | 11/1959 | Seron | 24/3.4 X |
| 2,947,456 | 8/1960 | Seron . | |
| 2,961,135 | 11/1960 | Hughes, Jr. | 224/219 |
| 3,186,611 | 6/1965 | Sonderman | 224/258 X |
| 4,322,077 | 3/1982 | Van't Hof . | |
| 4,752,270 | 6/1988 | Morton | 446/207 |
| 5,048,708 | 9/1991 | Musco . | |
| 5,082,156 | 1/1992 | Braun | 224/220 |
| 5,086,726 | 2/1992 | Sharp | 446/204 X |
| 5,111,981 | 5/1992 | Allen . | |
| 5,398,855 | 3/1995 | Schaiewitz . | |
| 5,489,126 | 2/1996 | Gray, Jr. . | |

FOREIGN PATENT DOCUMENTS

| | | | |
|---|---|---|---|
| 1116894 | 11/1907 | France | 224/220 |
| 6804 | 4/1893 | United Kingdom | 446/204 |
| 25619 | 11/1907 | United Kingdom | 446/204 |

*Primary Examiner*—Gregory M. Vidovich
*Attorney, Agent, or Firm*—Lathrop & Clark LLP

[57] ABSTRACT

A cord is formed into a loop with a metal clip, and is knotted about a rigid ear which protrudes from the body of a conventional whistle. A plastic tube is slipped over the knotted lanyard at the whistle ear and heat-shrunk in place, to cause the whistle to protrude from the lanyard on a generally rigid stem. When the lanyard is slipped onto the glove of the wearer, the protruding stem causes the whistle to extend outwardly from the glove and hence presents the mouthpiece of the whistle for ready grasping by the wearer's lips for rapid actuation of the whistle. Alternatively, the whistle is engaged to a hook-and-loop fastener flexible strap by a rigid clip, which extends through a fold in the strap. The connection between the clip and the fastener limits side to side twisting of the whistle, allowing ready blowing by the wearer.

8 Claims, 2 Drawing Sheets

WRIST MOUNTED WHISTLE

BACKGROUND OF THE INVENTION

The present invention relates generally to whistle mounting apparatus and particularly to wrist mounted apparatus which position the whistle for ready grasping by the user's lips.

Athletic coaches typically wear a whistle attached to a lanyard which is worn around the neck. When a coach wishes to signal a command to athletes during practice the grasps the whistle in his hand, raises it to his lips, and blows into it. The whistle provides a distinct and recognizable shrill which directs the athletes to begin or conclude some activity.

Many athletic coaches also participate in the practice activities. The coach may demonstrate a particular activity or skill, assist an athlete in a drill, or actively challenge an athlete in a competition. The direct participation enables the coach to provide both as increased motivation of the athletes and more precise feedback regarding skill and technique.

Some athletic activities require special protective gear to be worn on the hands. In particular, hockey and lacrosse require bulky padded gloves. Hockey and lacrosse coaches typically wear these gloves during practice so that they can safely participate in the sporting activity.

The thick fingers and heavy padding of protective hand coverings make grasping a whistle cumbersome. Thus, the coach may send a delayed signal because he can not quickly grasp the whistle and bring it to his lips. The timing of the signal to stop an activity can be critical to safety, especially in contact sports where an athlete may receive a surprise blow at the end of a drill if the stop signal has not sounded.

What is needed is an apparatus which attaches a whistle to the wrist and locates the whistle so that when the arm is raised, the whistle is positioned for ready grasping by the lips.

SUMMARY OF THE INVENTION

The whistle and mounting system of this invention attaches to the wrist or forearm of a wearer in such a way as to present the whistle for ready grasping between the wearer's lips. One embodiment of the system, for use by a wearer of heavy gloves, such as those worn by a hockey or lacrosse coach, has a resilient cord which is formed into a loop with a metal clip, and is knotted about a rigid ear which protrudes from the body of a conventional whistle. A plastic tube is slipped over the knotted lanyard at the whistle ear and heat-shrunk in place, to cause the whistle to protrude from the lanyard on a generally rigid stem. When the resilient lanyard is slipped onto the glove of the wearer, the protruding stem causes the whistle to extend outwardly from the glove and hence presents the mouthpiece of the whistle for ready grasping by the wearer's lips for rapid actuation of the whistle.

In an alternative embodiment, the whistle is engaged to a flexible strap by a rigid clip, which extends through a fold in the strap. The strap is covered in part by hooks, and in part by loops of a hook-and-loop fastener, such that the strap may be readily adjusted to the diameter of the wearer's wrist, whether bare or covered with one or more layers of clothing. The diameter of the clip member which extends through the whistle ear is such that side to side twisting of the whistle on the clip is substantially limited, allowing the whistle to be presented on the strap for ready grasping by the wearer's lips, the tight fit of the whistle ear on the clip member also significantly limits the rotation of the whistle about the clip.

It is an object of the present invention to mount a whistle on a wearer's wrist to enable the wearer to present the whistle to the lips in a quick and simple motion.

It is another object of the present invention to mount a whistle on a person's wrist in a manner which enables the wearer to present the whistle to the lips without use of the fingers.

It is a still further object of the present invention to provide a glove mounted whistle for use by hockey coaches during hockey practice.

It is a further object of the present invention to provide a convenient and accessible manner of attaching a whistle to a person for rapid activation.

It is still another object of the present invention to provide a device for aiding the personal safety of a person.

It is an additional object of the present invention to provide an assembly for mounting a whistle to a wearer's bare or clothed wrist for ready presentation to the wearer's lips for blowing.

Further objects, features and advantages of the invention will be apparent from the following detailed description when taken in conjunction with the accompanying drawings.

DESCRIPTION OF THE PREFERRED EMBODIMENTS

Figure 1:
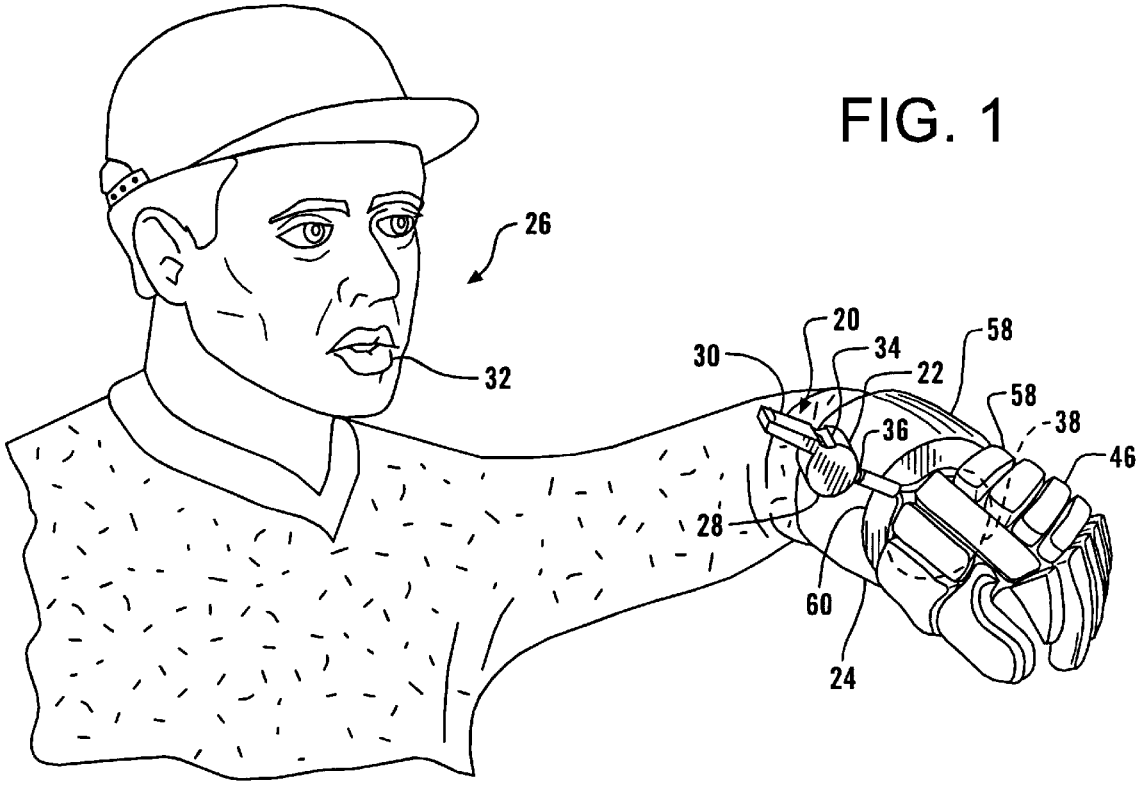
FIG. 1 is a perspective view of the wrist mounted whistle assembly of this invention attached to a hockey glove and being presented for actuation by a hockey coach.
Figure 2:
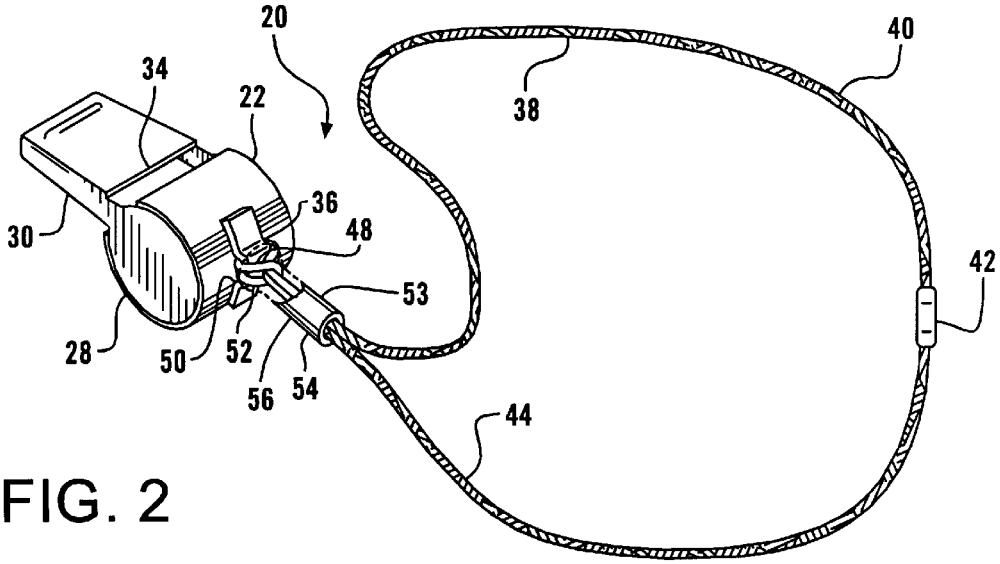
FIG. 2 is an isometric view of the wrist mounted whistle assembly of FIG. 1.
Figure 3:
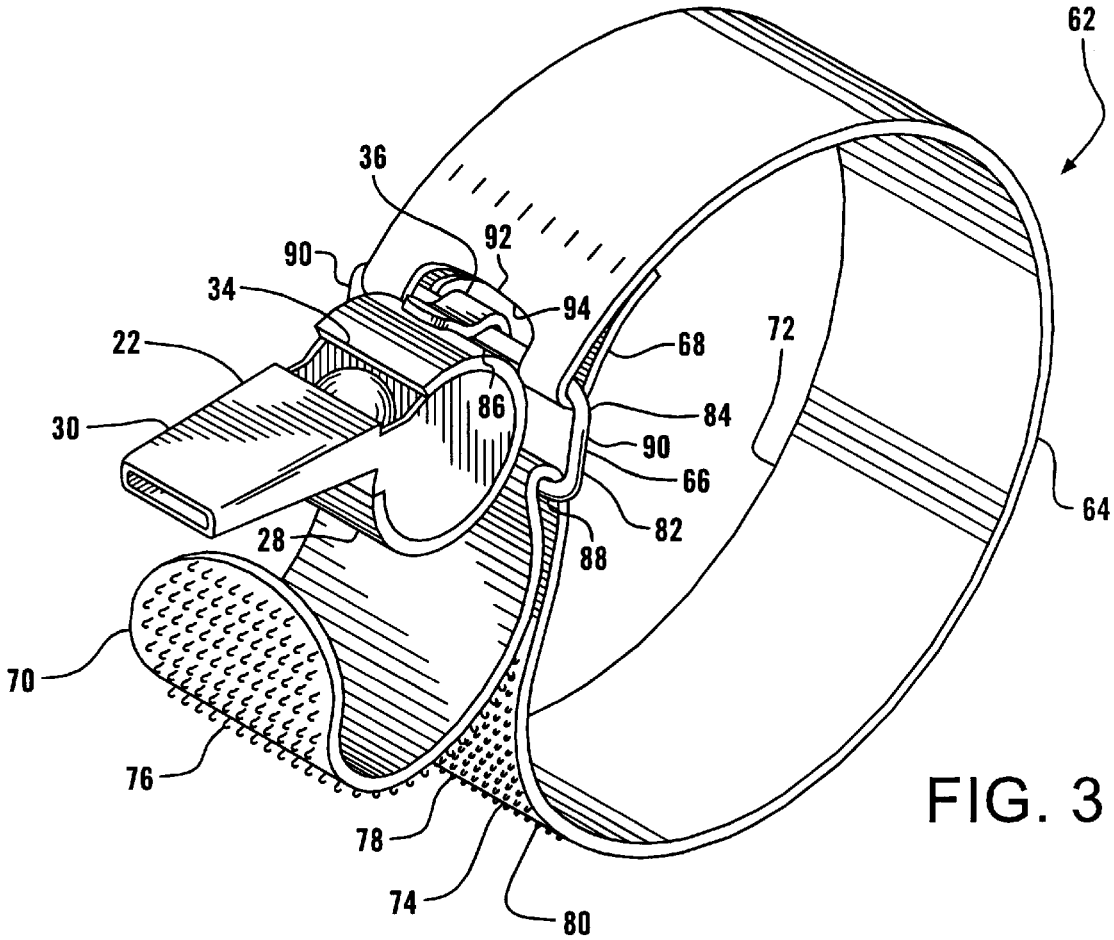
FIG. 3 is an isometric view, partially cut-away in section, of an alternative wrist mounted whistle of this invention having a broad strap for use by a wearer without heavy gloves.

Referring more particularly to FIGS. 1–3, wherein like numbers refer to similar parts, an apparatus 20 which mounts a whistle 22 to the wrist 24 of a wearer 26 is shown in FIGS. 1–2. The whistle 22 of a conventional type, having a generally mandolin-shaped body 28 with a frontwardly protruding mouthpiece 30 intended to be grasped between the lips 32 of the wearer and blown to emit a piercing whistling noise. An air escape aperture 34 is defined between the mouthpiece 30 and a rearwardly protruding ear 36. The ear 36 is positioned opposite the mouthpiece, and is a rigid member which is fixed to or formed integrally with the whistle body 28. The whistle 22 may be formed of metal or plastic.

A resilient cord 38, shown in FIG. 2, is formed into a loop 40 by the fastening of the two ends of the cord together with a crimped brass clip 42. The looped cord 38 defines a lanyard 44 for conveniently fastening the whistle 22 to the glove 46 of a wearer, as shown in FIG. 1. The lanyard 44 is attached to the whistle 22 by passing a first loop end 48 through an opening 50 in the whistle ear 36, folding the first loop end 180 degrees about the ear, and then passing the first loop end through the portion of the lanyard loop 40 which remains outside the ear and pulling the first loop end through until the lanyard is snugged up against the ear 36 in a knot 52.

In order to present the whistle 22 in a fashion to be readily grasped by the wearer's lips, it is necessary that the whistle be mounted in such a way that the whistle mouthpiece projects generally perpendicularly to the wearer's wrist. If the mouthpiece lies alongside the wrist, it will be difficult to grasp and will impede the rapid engagement and actuation of the whistle by the wearer. As shown in FIG. 2, to achieve the proper presentation of the whistle, a casing 53 is positioned about the ear 36, the knot 52 and a length of the lanyard 44 extending rearwardly from the knot to define a generally stiff stem 54 which extends rearwardly from the whistle 22 and which connects the whistle to the lanyard loop 40.

The casing 53 may be formed by an adhesive or a strip of adhesive tape wrapped about the lanyard cord, but in a preferred embodiment is formed by a heat-shrinkable tube 56 which surrounds the knot and portions of the lanyard, and to which heat is applied to shrink the tube into a tight and secure casing around the knot. The effect of the casing is to form a stiff segment comprised of the stem and the ear.

The apparatus 20 is particularly well adapted to use by coaches in sports calling for the wearing of protective gloves, for example hockey and lacrosse. A coach in these sports will commonly be outfitted with the protective equipment of a player while giving instruction. The piercing noise of a whistle is effectively used by the coach to issue general commands to the players undergoing training. The whistle sound carries well across the large playing fields associated with these sports, and can also be heard clearly by players wearing protective headgear.

As shown in FIG. 1, a hockey glove 46 is provided with an array of pads 58, and will generally have a pad or pads which encircle the wrist and define a wrist groove 60. The looped lanyard 44 may be positioned on the wearer's sleeve prior to donning the glove 46, and is then easily brought down over the glove into engagement within the groove 60. When mounted on the glove 46, the stiffened stem 54 causes the whistle 22 to protrude outwardly from the glove in a fashion to present the mouthpiece in line with the wearer's lips when the wearer's wrist is brought up to his mouth.

An alternative embodiment wrist-mounted whistle assembly 62 of this invention, shown in FIG. 3, is adapted for wear by users who are not wearing a heavy glove. In the assembly 62, the whistle 22 is engaged to a flexible strap 64 by a metal or plastic clip 66. The strap 64 extends from a first end 68 to a second end 70. The strap 64 has an inner surface 72 which faces the wrist 24. On the exterior surface 74, positioned opposite the inner surface 72, the strap is formed with a hook segment 76 which has a number of protruding hooks and a loop segment 78 which has a number of protruding loops which together form a hook and loop type fastener 80.

The clip 66 defines a generally rectangular substantially enclosed loop 82. The clip loop is defined by a first segment 84, which may be formed in two parts with a gap 86 between the parts, and a second segment 88 which is spaced parallel to the first segment by two shorter side segments 90.

The first end 68 of the strap 64 extends around the first segment 84 of the clip 66 and is fastened to itself for example by sewing. The clip is thus fastened to the strap and positions the second segment 88 of the strap to receive the second end 70 of the strap 64. The second end 70 of the strap 64 is passed through the clip when the strap is positioned on a wearer's wrist 24. The second end 70 of the strap 64 folds back over the second segment 88 of the clip 66 and onto itself so that the hook segment 76 faces the loop segment 78 and may be engaged with the loop segment to secure the assembly 62 to the wearer's wrist 24.

The first segment 84 of the clip 66 extends through the whistle ear 36 to secure the whistle 22 to the clip. The diameter of the clip first segment 84 is only slightly less than the interior diameter of the whistle ear opening 50, thus serving to restrict side-to-side twisting of the whistle on the clip. Preferably, the fit is sufficiently tight to limit the unhindered pivoting of the whistle on the clip, but sufficiently loose to permit it to be pivoted in response to hand pressure. This fit prevents a floppy mount of the whistle to the clip, and permits the whistle to be retaned in roughly a constant position with respect to the wearer's wrist. The whistle ear 36 protrudes through a generally circular ear-receiving opening 92 cut in the strap 64. The edge 94 of the ear-receiving opening 92 generally tracks the profile of the whistle ear 36 to restrict the rearward range of pivot of the whistle 22. For purposes of illustration, the perimeter of the opening 92 has been shown slightly spaced from the ear of the whistle, however, in a preferred embodiment the cloth would be more nearly adjacent to the ear.

The whistle 22 is thus mounted in a manner that permits pivoting about an axis parallel to the axis of the wearer's arm, but which generally limits pivoting perpendicular to that axis. Furthermore, the body of the whistle prevents the whistle mouthpiece from pivoting downwardly excessively. The assembly thus presents the whistle for easy grasping by a user.

This whistle assembly 62 is particularly well adapted for use by bare-handed coaches, physical education teachers, bicycle-mounted police officers and other persons who would wear the apparatus on a bare wrist or over a light glove. The strap 64 distributes the weight of the apparatus across a broad portion of the wrist 24 for a comfortable fit. The broad contact area also resists lateral and rotational sliding on the wrist 24. The assembly 62 is also adapted for use by hunters and/or dog trainers or others who may have one hand occupied, for example in holding a hunting rifle. The assembly may also be used as a safety whistle, for example be persons who desire a means of immediately signaling peril late at night. By mounting a whistle on their person in a readily graspable position, the endangered person is ready to immediately sound a loud and piercing call for assistance immediately upon detecting a source of danger, without the need to extract a whistle from a pocket or purse, or locate a whistle on a dangling next supported lanyard.

It should be noted that the term "wrist" has been used herein to refer to a location along a wearer's forearm between the elbow and the beginning of the fingers, as there is a range of positions at which the assembly may be mounted for comfortable placement to suit the needs of a particular user.

It is understood that the invention is not limited to the particular construction and arrangement of parts herein illustrated and described, but embraces such modified forms thereof as come within the scope of the following claims.

I claim:

1. An apparatus for securing a whistle on a wearer's wrist and presenting the whistle for ready grasping by the wearer's lips, the apparatus comprising:

a whistle having a frontwardly facing mouthpiece and a rearwardly protruding ear positioned rearward of the mouthpiece, the ear having an attachment opening therein;

a lanyard defining a loop and having portions which extend through the attachment opening in the whistle car to connect the lanyard to the whistle; and a casing wrapped about portions of the lanyard to define a stem which protrudes rearwardly from the whistle, said casing further positioned about the ear to form a stiff segment comprised of the stem and the ear, the stem serving to position the whistle outwardly from the loop, the whistle being thereby positioned to present the whistle mouthpiece toward a wearer's lips for ready grasping by the lips when the wrist is lifted toward the lips.

2. The apparatus of claim 1 wherein the casing comprises a heat-shrinkable sleeve which surrounds the stem and which is shrink-fit to form the stem.

3. The apparatus of claim 2 wherein the lanyard is attached to the whistle with a knot and the knot is encompassed by the heat shrinkable sleeve.

4. The apparatus of claim 3 wherein a loop end of the looped lanyard passes through the attachment opening of the whistle, bends 180 degrees, and passes through an opening defined between the lanyard loop and the whistle ear to create the knot.

5. The apparatus of claim 1 wherein the lanyard is secured to an article to be worn on the wrist.

6. The apparatus of claim 1 wherein the casing comprises a strip of tape wrapped around said looped lanyard.

7. A glove and whistle assembly comprising:

a glove;

a whistle having a frontwardly facing mouthpiece and a rearwardly facing ear;

a lanyard which encircles the glove in a loop; and a casing wrapped about portions of the lanyard which extend outwardly from the glove and which are fixed to the whistle to define a stem which protrudes from the glove approximately perpendicular to the lanyard loop, said casing further positioned about the ear to form a stiff segment comprised of the stem and the ear, to thereby present the whistle for ready grasping by the lips of a wearer of the glove.

8. The assembly of claim 7 wherein the glove has portions defining a plurality of pads, and wherein a groove is defined by the pads which encircles the glove, and the lanyard loop is received within the groove.

* * * * *